US009442449B2

(12) United States Patent
Watanabe et al.

(10) Patent No.: US 9,442,449 B2
(45) Date of Patent: Sep. 13, 2016

(54) IMAGE FORMING APPARATUS

(71) Applicant: CANON KABUSHIKI KAISHA, Tokyo (JP)

(72) Inventors: Toshiyuki Watanabe, Yokohama (JP); Takahiro Azeta, Kawasaki (JP); Kazuhiro Hosohara, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/953,637

(22) Filed: Nov. 30, 2015

(65) Prior Publication Data

US 2016/0161893 A1 Jun. 9, 2016

(30) Foreign Application Priority Data

Dec. 8, 2014 (JP) ..... 2014-248031

(51) Int. Cl.
*G03G 15/00* (2006.01)
*G03G 15/01* (2006.01)

(52) U.S. Cl.
CPC ..... *G03G 15/6567* (2013.01)

(58) Field of Classification Search
CPC ..... G03G 15/00; G03G 21/00; G03G 15/01; G03G 15/6567
USPC ..... 399/361, 381, 388, 394
See application file for complete search history.

(56) References Cited

U.S. PATENT DOCUMENTS 4,268,943 A 5/1981 Watanabe et al.
4,953,846 A 9/1990 Azeta et al.
5,115,281 A 5/1992 Ohtsuka et al.
5,162,857 A 11/1992 Higeta et al.
8,725,057 B2 * 5/2014 Iino ..... G03G 15/6558 399/121
8,948,680 B2 2/2015 Nishimura
2006/0180973 A1 * 8/2006 Igarashi ..... G03G 21/1853 271/4.01
2010/0143013 A1 6/2010 Azeta
2011/0129276 A1 * 6/2011 Kondo ..... G03G 21/1695 400/613
2013/0070310 A1 * 3/2013 Watanabe ..... H04N 1/047 358/474
2013/0322945 A1 12/2013 Nishimura
2014/0178086 A1 * 6/2014 Kitamura ..... G03G 15/5008 399/46
2015/0220039 A1 * 8/2015 Mori ..... G03G 15/6561 399/395

FOREIGN PATENT DOCUMENTS

JP 55040473 A * 3/1980 ..... G03G 15/01
JP 02-287565 A 11/1990
JP 2001-117465 A 4/2001
JP 2004-264456 A 9/2004
JP 2013-246376 A 12/2013
JP 2014-106485 A 6/2014

* cited by examiner

*Primary Examiner* — Nguyen Ha
(74) *Attorney, Agent, or Firm* — Fitzpatrick, Cella, Harper & Scinto

(57) ABSTRACT

The image forming apparatus configured such that a primarily-transferred toner image is secondarily transferred onto a recording material at a secondary transfer portion formed between a transfer belt and a secondary transfer roller, includes a belt unit configured to support the transfer belt in a rotatable manner; and a sheet feeding unit configured to feed the recording material toward the secondary transfer portion. Both the belt unit and the sheet feeding unit are positioned and fixed on the same main stay, so that higher printing accuracy is achieved in consideration of a mutual positional relationship between the sheet feeding portion and the image forming portion.

10 Claims, 15 Drawing Sheets

IMAGE FORMING APPARATUS

BACKGROUND OF THE INVENTION

1. Field of the Invention

The present invention relates to an image forming apparatus, such as a copying machine or a printer, having a function of forming an image on a recording material such as a sheet.

2. Description of the Related Art

Image forming apparatus, such as a copying machine, a printer, and a facsimile, have been required to achieve higher printing accuracy and cost reduction.

Accordingly, it has been important to attain a simple configuration, and to enhance accuracy of positions of a sheet feeding portion and an image forming portion for a recording material.

In Japanese Patent Application Laid-Open No. 2014-106485, there is disclosed such a configuration that a belt unit is positioned on a frame member of an image forming apparatus. The belt unit includes an intermediate transfer belt onto which a toner image on a photosensitive member is primarily transferred.

Further, in Japanese Patent Application Laid-Open No. H02-287565, there is disclosed a configuration of a sheet feeding unit including a sheet feeding roller and a separation roller.

In order to enhance printing accuracy in the image forming apparatus, it may be important not only to position the image forming portion, but also to set a mutual positional relationship between a sheet feeding unit and an image forming unit for the recording material with good accuracy.

SUMMARY OF THE INVENTION

An object of the present invention is to achieve higher printing accuracy in consideration of a mutual positional relationship between a sheet feeding unit and an image forming unit.

In order to achieve the object described above, according to one embodiment of the present invention, another object of the invention is to provide an image forming apparatus, including a photosensitive member on which a toner image is formed, an endless and rotatable belt onto which the toner image borne on the photosensitive member is primarily transferred at a primary transfer portion formed between the photosensitive member and the endless and rotatable belt, a belt unit configured to support the endless and rotatable belt in a rotatable manner, and a sheet feeding unit configured to feed a recording material toward a secondary transfer portion at which the primarily-transferred toner image is secondarily transferred onto the recording material, the secondary transfer portion being formed between the endless and rotatable belt and a transfer device, wherein the belt unit and the sheet feeding unit are positioned and fixed on the same positioning member.

A further object of the invention is to provide an image forming apparatus including a photosensitive member on which a toner image is formed, an endless and rotatable belt configured to convey a recording material while bearing the recording material, a belt unit configured to support the endless and rotatable belt in a rotatable manner, and a sheet feeding unit configured to feed the recording material toward the endless and rotatable belt so that the recording material is borne and conveyed by the endless and rotatable belt, the image forming apparatus being configured to transfer the toner image borne on the photosensitive member when the recording material passes through a transfer portion formed between the photosensitive member and the endless and rotatable belt, wherein the belt unit and the sheet feeding unit are positioned and fixed on the same positioning member.

Further features of the present invention will become apparent from the following description of exemplary embodiments with reference to the attached drawings.

DESCRIPTION OF THE EMBODIMENTS

An exemplary embodiment of the present invention is described below in detail with reference to the attached drawings. Note that, dimensions, materials, and shapes of components described in the embodiment, a relative arrangement thereof, and other such factors may be appropriately changed depending on structures of apparatus to which the present invention is applied or various conditions, and are not intended to limit the scope of the present invention to the following embodiment.

Embodiment

Now, an embodiment of the present invention is described.

In this embodiment, as an image forming apparatus, there is exemplified an electrophotographic full-color image forming apparatus to which four process cartridges are removably mounted. However, the number of the process cartridges to be mounted to the image forming apparatus is not limited thereto, but may be set to the appropriate number as needed. For example, in a case of an image forming apparatus configured to form a monochrome image, one process cartridge is mounted to the image forming apparatus.

Further, in this embodiment, a printer is exemplified as a mode of the image forming apparatus, but the present invention is not limited thereto. For example, the present invention is also applicable to an image forming apparatus such as a copying machine or a facsimile machine, and to an image forming apparatus such as a multifunction peripheral having combined functions of copying and facsimile.

<<Schematic Configuration of Image Forming Apparatus>>

Figure 1:
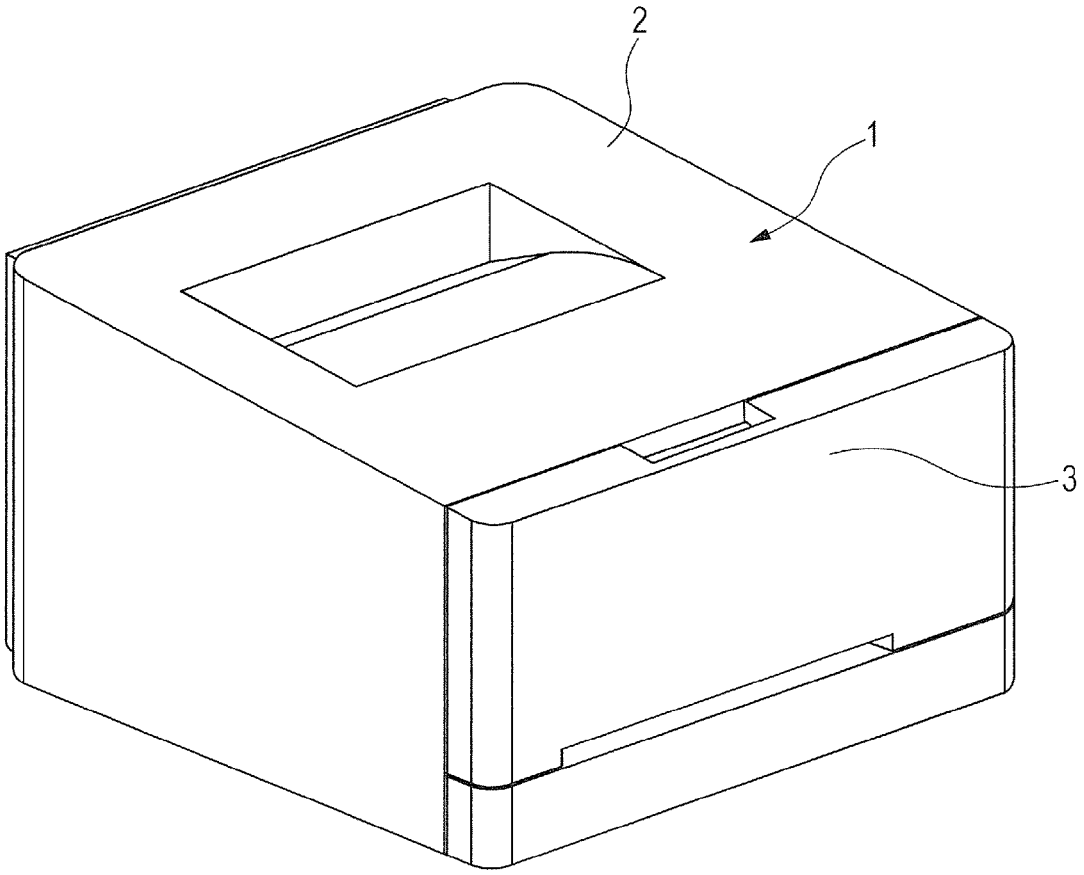
FIG. 1 is a perspective view for illustrating an external appearance of an image forming apparatus according to an embodiment of the present invention.
Figure 2:
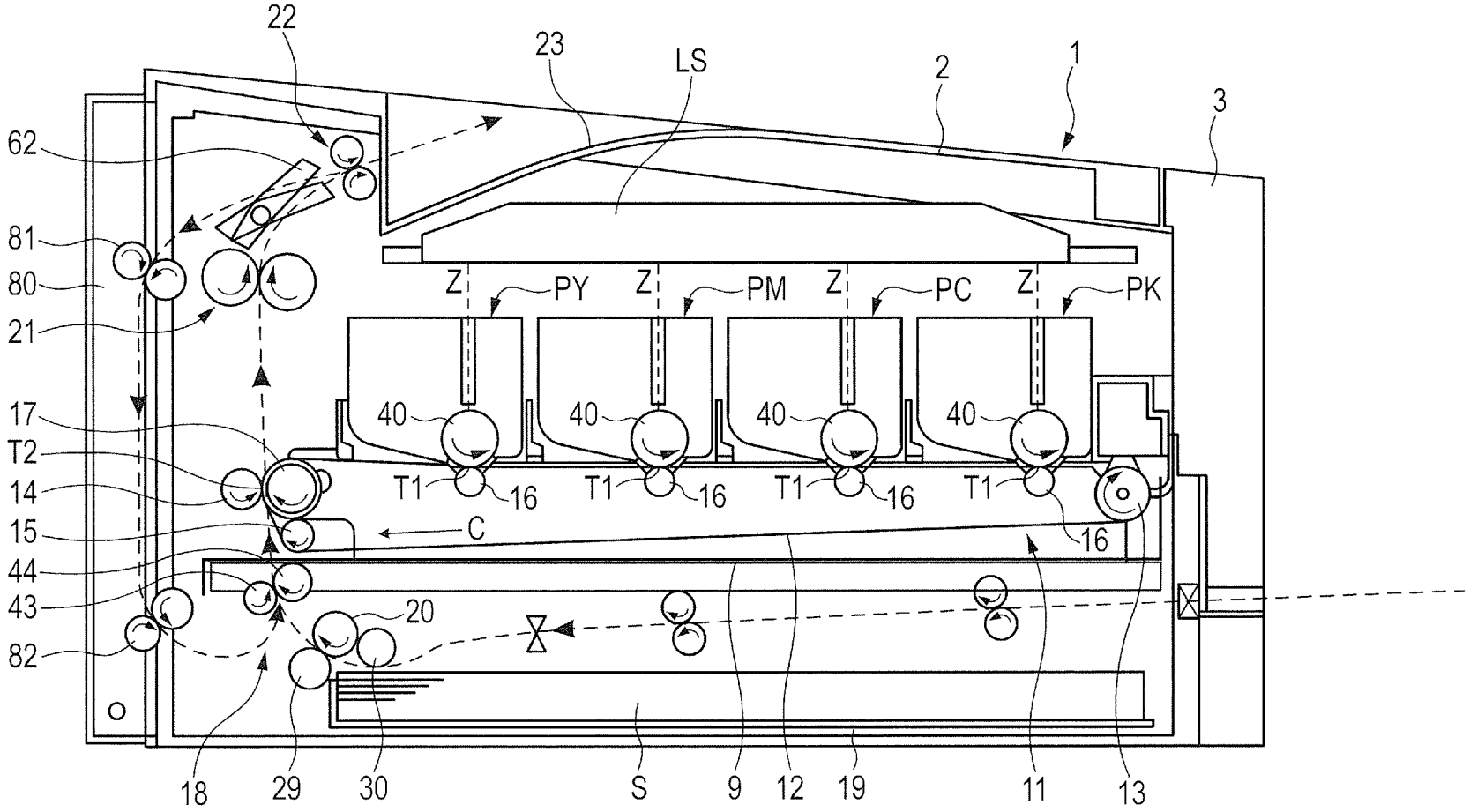
FIG. 2 is a sectional view for illustrating a schematic configuration of the image forming apparatus according to the embodiment of the present invention.

FIG. 1 is a perspective view for illustrating an external appearance of the image forming apparatus according to this embodiment, and FIG. 2 is a sectional view for illustrating a schematic configuration of the image forming apparatus according to this embodiment.

An image forming apparatus 1 according to this embodiment is a four-full-color laser printer using an electrophotographic process, and forms a color image on a recording material S. In this embodiment, the image forming apparatus of a process cartridge type is employed. Process cartridges (hereinafter referred to as "cartridges") P are removably mounted to an image forming apparatus main body (hereinafter referred to as "apparatus main body") 2 of the image forming apparatus 1.

In this embodiment, a side of the image forming apparatus 1 on which an apparatus opening and closing door 3 is arranged is referred to as a front (front side), and a side of the image forming apparatus 1 opposite to the front is referred to as a rear (rear side). Further, a right side of the image forming apparatus 1 in a horizontal direction when viewed from the front is referred to as a right side of the image forming apparatus 1, and a left side thereof in the horizontal direction is referred to as a left side of the image forming apparatus 1. Further, a vertical direction of the image forming apparatus 1 in a placed state is referred to as an up-and-down direction.

Four cartridges, namely, a first cartridge PY, a second cartridge PM, a third cartridge PC, and a fourth cartridge PK are arranged in the apparatus main body 2 along the horizontal direction. The first to fourth cartridges (PY, PM, PC, and PK) have substantially the same electrophotographic process mechanism except that developers (hereinafter referred to as "toners") of different colors are used. A rotational driving force is transmitted from an image forming drive motor of the apparatus main body 2 to each of the first to fourth cartridges PY, PM, PC, and PK. Further, a bias voltage (such as charging bias or developing bias) is applied from the apparatus main body 2 to each of the first to fourth cartridges PY, PM, PC, and PK.

In this case, the first cartridge PY contains a yellow (Y) toner, and forms a yellow toner image on a surface of a photosensitive member (photosensitive drum) 40 serving as an image bearing member. The second cartridge PM contains a magenta (M) toner, and forms a magenta toner image on a surface of another photosensitive member 40. The third cartridge PC contains a cyan (C) toner, and forms a cyan toner image on a surface of still another photosensitive member 40.

The fourth cartridge PK contains a black (K) toner, and forms a black toner image on a surface of still another photosensitive member 40.

A laser scanner unit LS serving as an exposure unit is arranged above the first to fourth cartridges PY, PM, PC, and PK. To each of the cartridges, the laser scanner unit LS outputs a laser beam Z corresponding to image information. Then, the laser beam Z passes through an exposure window portion formed in each of the cartridges to scan and expose the surface of each photosensitive member 40.

A belt unit 11 is arranged below the first to fourth cartridges PY, PM, PC, and PK. The belt unit 11 includes an endless intermediate transfer belt (hereinafter referred to as "transfer belt") 12 having flexibility, a drive roller 13, a turn roller 17, and a tension roller 15. The transfer belt 12 is stretched (laid with a tension) around the respective rollers so as to be rotatable.

The photosensitive member 40 of each of the first to fourth cartridges PY, PM, PC, and PK is structured so that a lower surface thereof is held in contact with an upper surface of the transfer belt 12. The contact portion forms a primary transfer portion T1. A primary transfer roller 16 is arranged on an inner side of the transfer belt 12 so as to be opposed to the photosensitive member 40.

A secondary transfer roller (transfer device) 14 is structured so as to be held in abutment on the turn roller 17 through intermediation of the transfer belt 12. The contact portion between the transfer belt 12 and the secondary transfer roller 14 forms a secondary transfer portion T2.

A sheet feeding unit 18 is arranged below the belt unit 11, and is configured to feed the recording material S toward the secondary transfer portion T2. The sheet feeding unit 18 includes a sheet feeding tray 19 on which the recording materials S are stacked and received, a pickup roller 30, a feed roller 20, and pairs of conveying rollers (hereinafter referred to as "pairs of registration rollers") 43 and 44.

The pickup roller (sheet feeding device) 30 feeds the recording materials S received in the sheet feeding tray (stacking unit) 19. The feed roller 20 is paired with a separation roller (separation device) 29 to convey the recording materials S fed by the pickup roller 30 one by one. Even when the pickup roller 30 feeds a plurality of recording materials S, the feed roller 20 and the separation roller 29 can separate and convey the recording materials S one by one. The pairs of registration rollers 43 and 44 construct a skew feeding correction device together with skew feeding correction members (hereinafter referred to as "registration shutters") 45 described later, to thereby correct skew feeding of the recording materials S conveyed by the feed roller 20 and the separation roller 29 one by one. In this case, more specifically, each pair of registration rollers 43 and 44 is constructed by a registration drive roller 43 and a registration idler roller 44. Each registration shutter 45 is arranged on a shaft portion of the registration idler roller 44.

In FIG. 2, a fixing unit 21 and discharge rollers 22 are arranged in an upper left portion of the apparatus main body 2. A discharge tray 23 is arranged in an upper surface of the apparatus main body 2.

<<Image Forming Operation>>

Next, an operation of forming a full-color image is described.

When a printing signal is input, the photosensitive member 40 of each of the first to fourth cartridges PY, PM, PC, and PK is driven to rotate at predetermined speed in a direction indicated by the arrow of FIG. 2 (counterclockwise direction).

The transfer belt 12 is also driven to rotate in a forward direction of the rotation of the photosensitive member 40 (direction indicated by the arrow C of FIG. 2) at speed corresponding to the speed of the photosensitive member 40.

The laser scanner unit LS scans and exposes the surface of each photosensitive member 40 by the laser beam Z in response to an image signal of each color.

In this manner, a latent image (electrostatic latent image) based on the image signal of corresponding color is formed on the surface of each photosensitive member 40. The latent image formed on the photosensitive member 40 is developed by a developing roller that is driven to rotate at predetermined speed.

Through this operation of the electrophotographic image forming process, a yellow toner image corresponding to a yellow component of the full-color image is formed on the photosensitive member 40 of the first cartridge PY. Then, the toner image is primarily transferred onto the transfer belt 12 at the primary transfer portion T1.

Similarly, a magenta toner image corresponding to a magenta component of the full-color image is formed on the photosensitive member 40 of the second cartridge PM. Then, the toner image is primarily transferred so as to be overlaid onto the yellow toner image that has been already transferred onto the transfer belt 12. Similarly, a cyan toner image corresponding to a cyan component of the full-color image is formed on the photosensitive member 40 of the third cartridge PC. Then, the toner image is primarily transferred so as to be overlaid onto the yellow and magenta toner images that have been already transferred onto the transfer belt 12. Similarly, a black toner image corresponding to a black component of the full-color image is formed on the photosensitive member 40 of the fourth cartridge PK.

In this manner, the yellow, magenta, cyan, and black unfixed toner images corresponding to the four-full-color image are formed on the transfer belt 12.

On the other hand, when the printing signal is input, the recording materials S received in the sheet feeding tray 19 are fed by the pickup roller 30. The fed recording materials S are guided into a nip between the feed roller 20 and the separation roller 29 to be separated and conveyed one by one. Then, each recording material S is subjected to correction of skew feeding performed by the registration shutters 45, and is guided into nips between the pairs of registration rollers 43 and 44.

At a predetermined control timing, the recording material S passes through a hole 9*i* formed in a main stay 9, which is described later, to allow passage of the sheet (allow passage of the recording material). Then, the recording material S is guided into the secondary transfer portion T2 at which the secondary transfer roller 14 and the transfer belt 12 are held in abutment on each other. Then, while the recording material S is conveyed through the secondary transfer portion T2, the four-color toner images on the transfer belt 12 are secondarily transferred collectively onto the surface of the recording material S. After that, the toner images transferred onto the recording material S are fixed onto the recording material S by a fixing device arranged in the fixing unit 21. The recording material S on which the toner images are fixed is discharged onto the discharge tray 23 by the discharge rollers 22.

When duplex printing is performed, after a vicinity of a trailing edge of the recording material S reaches the discharge rollers 22, a flapper 62 is moved to a duplex conveyance position, and the discharge rollers 22 are rotated reversely. In this manner, the recording material S is conveyed into a duplex unit 80. After that, the recording material S is conveyed to the pairs of registration rollers 43 and 44 by duplex conveying rollers 81 and 82. Then, similarly to the image forming operation performed on the first side of the recording material, an image forming operation is performed on a second side of the recording material. In this manner, the recording material S having the images formed on the both sides thereof is discharged onto the discharge tray 23.

<<Configurations of Sheet Feeding Portion and Transfer Portion>>

Figure 3:
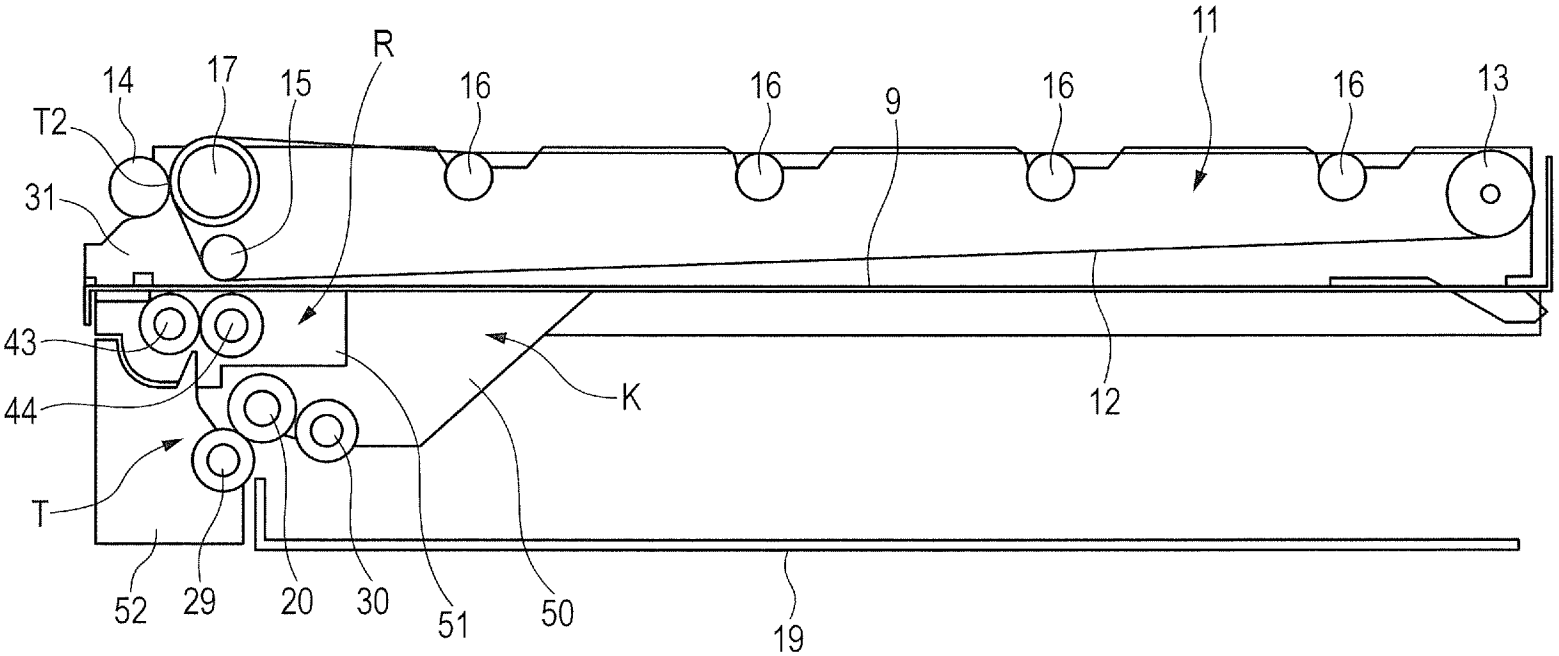
FIG. 3 is a sectional view for illustrating schematic configurations of a vicinity of a sheet feeding portion and a transfer portion according to the embodiment of the present invention.

FIG. 3 is a sectional view for illustrating schematic configurations of a vicinity of a sheet feeding portion and a transfer portion.

In FIG. 3, the main stay 9, a belt frame 31, an FP cover 50, a registration cover 51, a separation roller holding cover 52, a registration unit R, a pickup unit K, and a separation roller unit T are illustrated.

In this case, the main stay 9 constructs a frame member of the apparatus main body 2 together with a left side plate 6 and a right side plate 7 arranged as a pair so as to be opposed to each other, and corresponds to a connecting member configured to connect the left side plate 6 and the right side plate 7 to each other. Further, the main stay 9 corresponds to the same positioning member on which both the belt unit 11 and the sheet feeding unit 18 are positioned and fixed. In this embodiment, the connecting member also serves as the positioning member, but the present invention is not limited thereto. The connecting member configured to connect the left side plate 6 and the right side plate 7 to each other, and the positioning member on which both the belt unit 11 and the sheet feeding unit 18 are positioned and fixed may be prepared as separate members. The main stay 9 is fastened to the left side plate 6 and the right side plate 7. The left side plate 6 and the right side plate 7 are described later.

Further, the belt frame 31 is a frame member of the belt unit 11, and corresponds to a support frame configured to support a plurality of rollers in a rotatable manner. The plurality of rollers stretches the transfer belt 12 in a rotatable manner. Further, the FP cover 50 is a cover member configured to hold the feed roller 20 and the pickup roller 30. Further, the registration cover 51 is a cover member configured to hold the pairs of registration rollers 43 and 44. Further, the separation roller holding cover 52 is a cover member configured to hold the separation roller 29.

Further, the registration unit R includes the registration cover 51 and the pairs of registration rollers 43 and 44. Further, the pickup unit K includes the FP cover 50, the feed roller 20, and the pickup roller 30. Further, the separation roller unit T includes the separation roller holding cover 52 and the separation roller 29. In this case, the registration unit R corresponds to a second unit, and the pickup unit K corresponds to a first unit. Further, the separation roller unit T corresponds to a third unit.

Figure 4A:
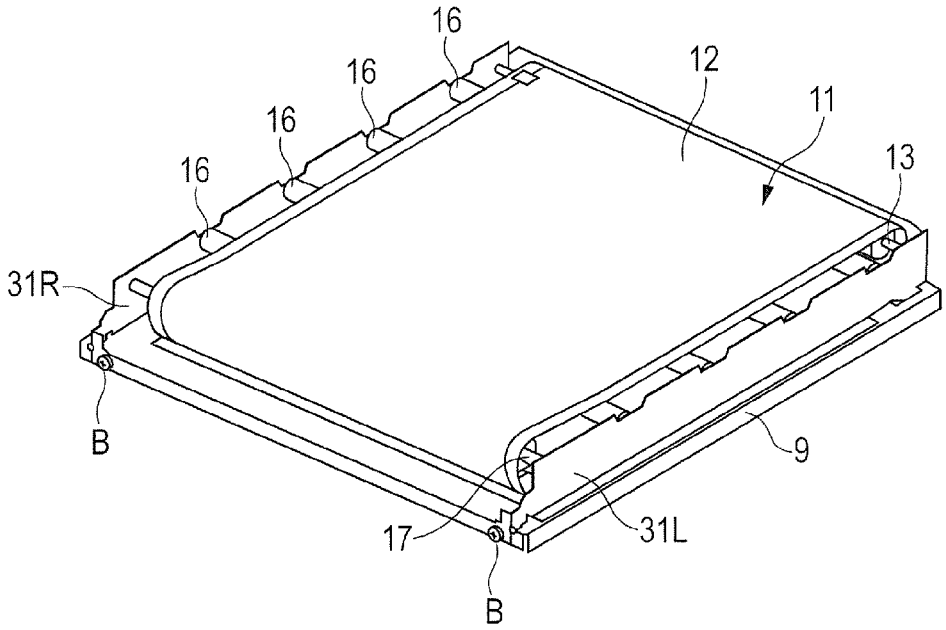
FIG. 4A is a perspective view for illustrating a belt unit according to the embodiment of the present invention.

FIG. 4A is a perspective view for illustrating a state in which the belt unit 11 is mounted to the main stay 9. As illustrated in FIG. 4A, the belt unit 11 includes a left belt frame portion 31L arranged on a left side of a main body of the belt unit, and a right belt frame portion 31R arranged on a right side of the main body of the belt unit. Although the details are described later, when the belt unit 11 is mounted to the main stay 9, the left belt frame portion 31L and the right belt frame portion 31R are positioned and fixed on the main stay 9.

Figure 4B:
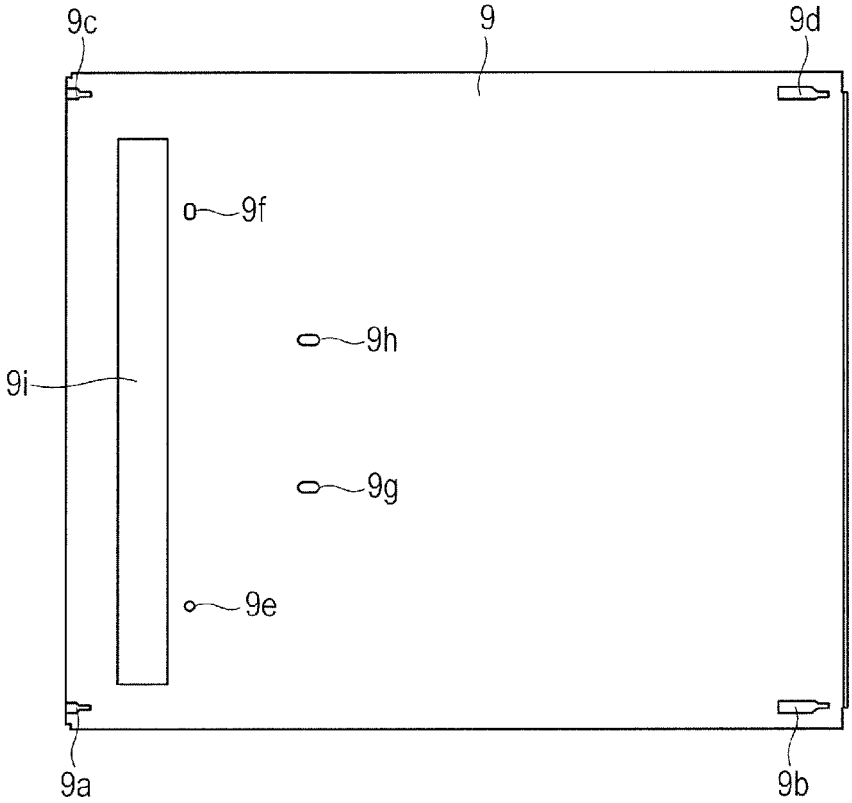
FIG. 4B is a top view for illustrating a main stay according to the embodiment of the present invention.

FIG. 4B is a top view for illustrating the main stay 9.

As illustrated in FIG. 4B, positioning holes 9*a*, 9*b*, 9*c*, and 9*d*, a round positioning hole 9*e*, an oblong positioning hole 9*f*, oblong positioning holes 9*g* and 9*h*, and the hole 9*i* allowing passage of the sheet are formed in the main stay 9.

FIG. 5A to FIG. 5D are top views for illustrating the positioning holes 9*a*, 9*b*, 9*c*, and 9*d* of the main stay 9, respectively.

Figure 5A:
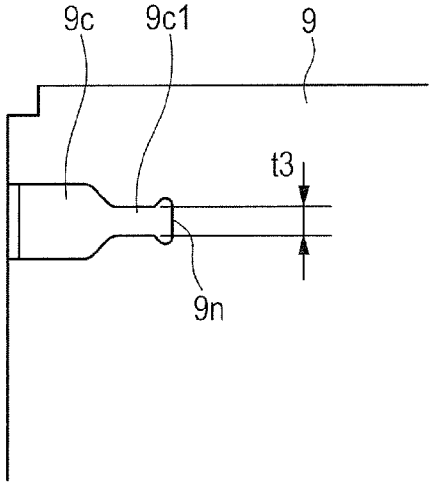
FIG. 5A, FIG. 5B, FIG. 5C, and FIG. 5D are top views for illustrating positioning holes of the main stay according to the embodiment of the present invention.
Figure 5C:
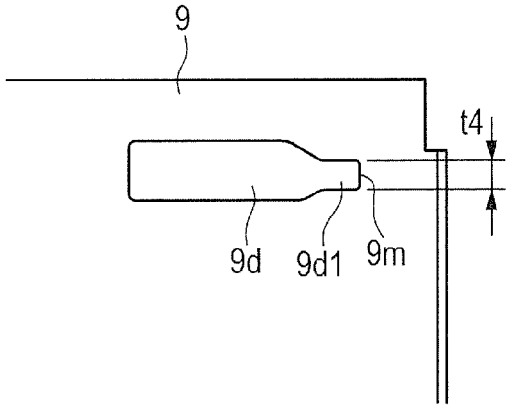
Figure 5B:
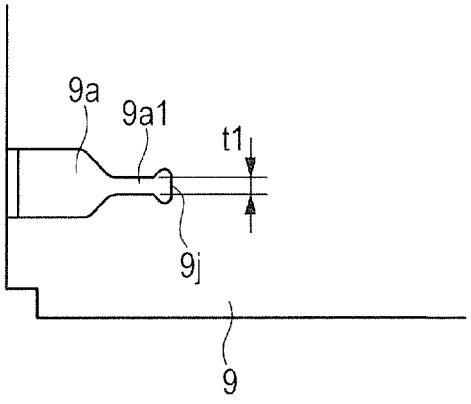
Figure 5D:
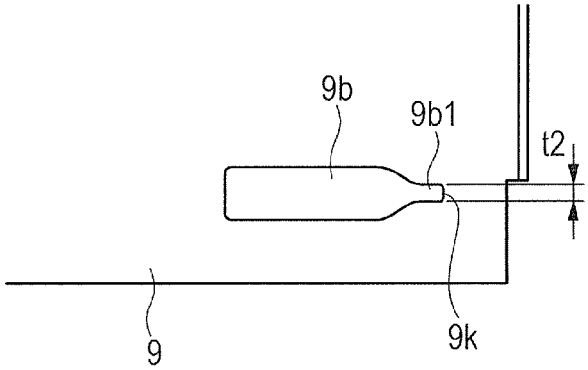

In FIG. 5A, the positioning hole 9*c*, a positioning abutment portion 9*n* of the positioning hole 9*c*, and a slit 9*c*1 of the positioning hole 9*c* having a width t3 are illustrated. In FIG. 5B, the positioning hole 9*a*, a positioning abutment portion 9*j* of the positioning hole 9*a*, and a positioning slit 9*a*1 of the positioning hole 9*a* having a width t1 are illustrated. In FIG. 5C, the positioning hole 9*d*, an end portion 9*m* of the positioning hole 9*d*, and a slit 9*d*1 of the positioning hole 9*d* having a width t4 are illustrated. In FIG. 5D, the positioning hole 9*b*, an end portion 9*k* of the positioning hole 9*b*, and a positioning slit 9*b*1 of the positioning hole 9*b* having a width t2 are illustrated.

In this case, the width t1 is substantially equal to a thickness of the belt frame 31. Further, the width t2 is equal to the width t1. Further, the width t3 is slightly larger than the width t1. Further, the width t4 is equal to the width t3.

Figure 6A:
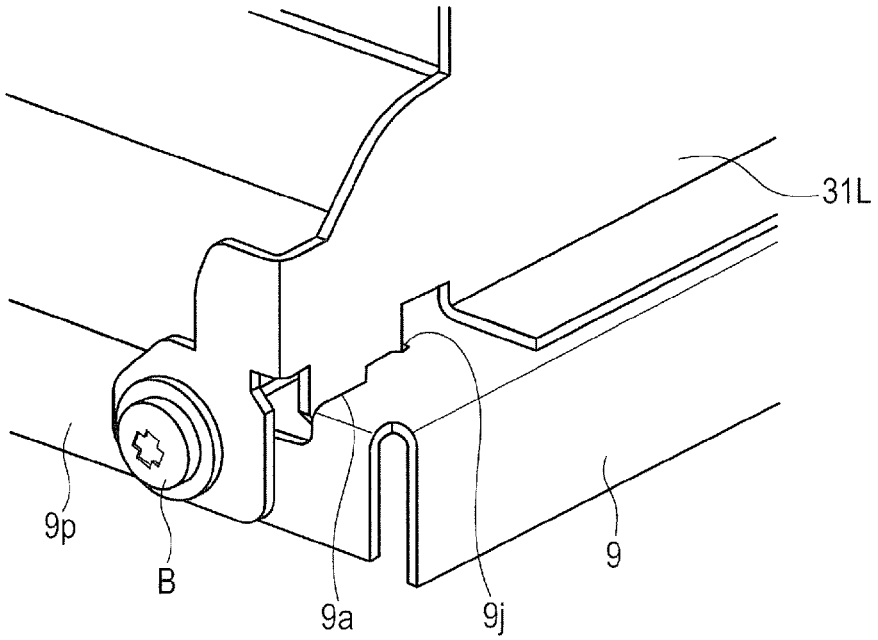
FIG. 6A and FIG. 6B are views for illustrating detailed configurations of the positioning holes of the main stay according to the embodiment of the present invention.

FIG. 6A is a perspective view for illustrating a detailed configuration of the positioning hole 9*a* of the main stay 9.

As illustrated in FIG. 6A, the main stay 9 and the left belt frame portion 31L are fixed together with a screw B. A gap is defined between a bent portion 9*p* of the main stay 9 and the left belt frame portion 31L before the main stay 9 and the left belt frame portion 31L are fastened to each other with the screw B. Further, as illustrated in FIG. 6A, under a state in which the left belt frame portion 31L is fitted into the positioning hole 9*a*, the screw B is tightened. Thus, the left belt frame portion 31L is brought into abutment on the positioning abutment portion 9*j* to be positioned and fixed on the main stay 9. Similarly, under a state in which the right belt frame portion 31R is inserted into the positioning hole 9*c*, the screw B is tightened. Thus, the right belt frame portion 31R is brought into abutment on the positioning abutment portion 9*n* to be positioned and fixed on the main stay 9.

Figure 6B:
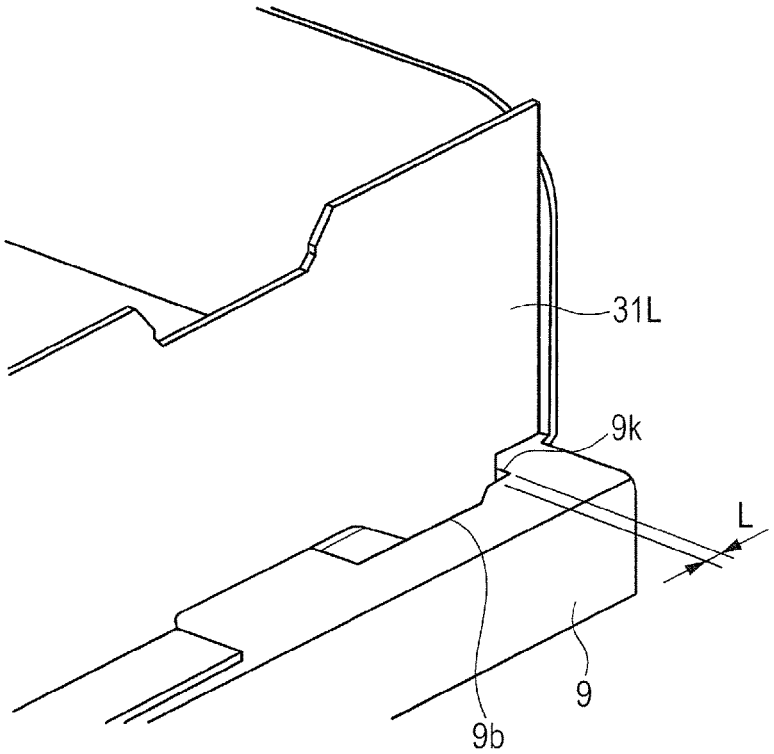

FIG. 6B is a perspective view for illustrating a detailed configuration of the positioning hole 9*b* of the main stay 9.

As illustrated in FIG. 6B, the left belt frame portion 31L is fitted into the positioning hole 9*b*. As illustrated in FIG. 6A, when the left belt frame portion 31L is brought into abutment on the positioning abutment portion 9*j* of the positioning hole 9*a* to be positioned and fixed on the main stay 9, a gap L is defined between the end portion 9*k* of the positioning hole 9*b* and the left belt frame portion 31L. Similarly, under the state in which the right belt frame portion 31R is inserted into the positioning hole 9*d* and the right belt frame portion 31R is positioned and fixed on the main stay 9, a gap is defined between the end portion 9*m* of the positioning hole 9*d* and the right belt frame portion 31R.

With this configuration, the belt unit 11 can be more reliably positioned and fixed on the main stay 9 in a front-and-rear direction, and workability of mounting work can be enhanced.

Further, the left belt frame portion 31L of the belt unit 11 is fitted into the slit 9*a*1 of the positioning hole 9*a* and the slit 9*b*1 of the positioning hole 9*b* so that the belt unit 11 is positioned on the main stay 9 in a right-and-left direction. Further, the right belt frame portion 31R is inserted into the slit 9*c*1 of the positioning hole 9*c* and the slit 9*d*1 of the positioning hole 9*d*. At this time, the width t3 and the width t4 are set to be larger than the width t1 and the width t2. Thus, a gap is defined between the slit 9*c*1 and the right belt frame portion 31R or between the slit 9*d*1 and the right belt frame portion 31R in the right-and-left direction. With this configuration, the belt unit 11 can be more reliably positioned and fixed on the main stay 9 in the right-and-left direction, and the workability of mounting work can be enhanced.

Description is continued referring back to FIG. 4A and FIG. 4B. The belt unit 11 is positioned on the main stay 9 by the positioning holes 9*a*, 9*b*, and 9*c*, and is fixed thereon with the screws B.

<<Configuration of Registration Unit R>>

Next, a detailed configuration of the registration unit R is described.

Figure 7:
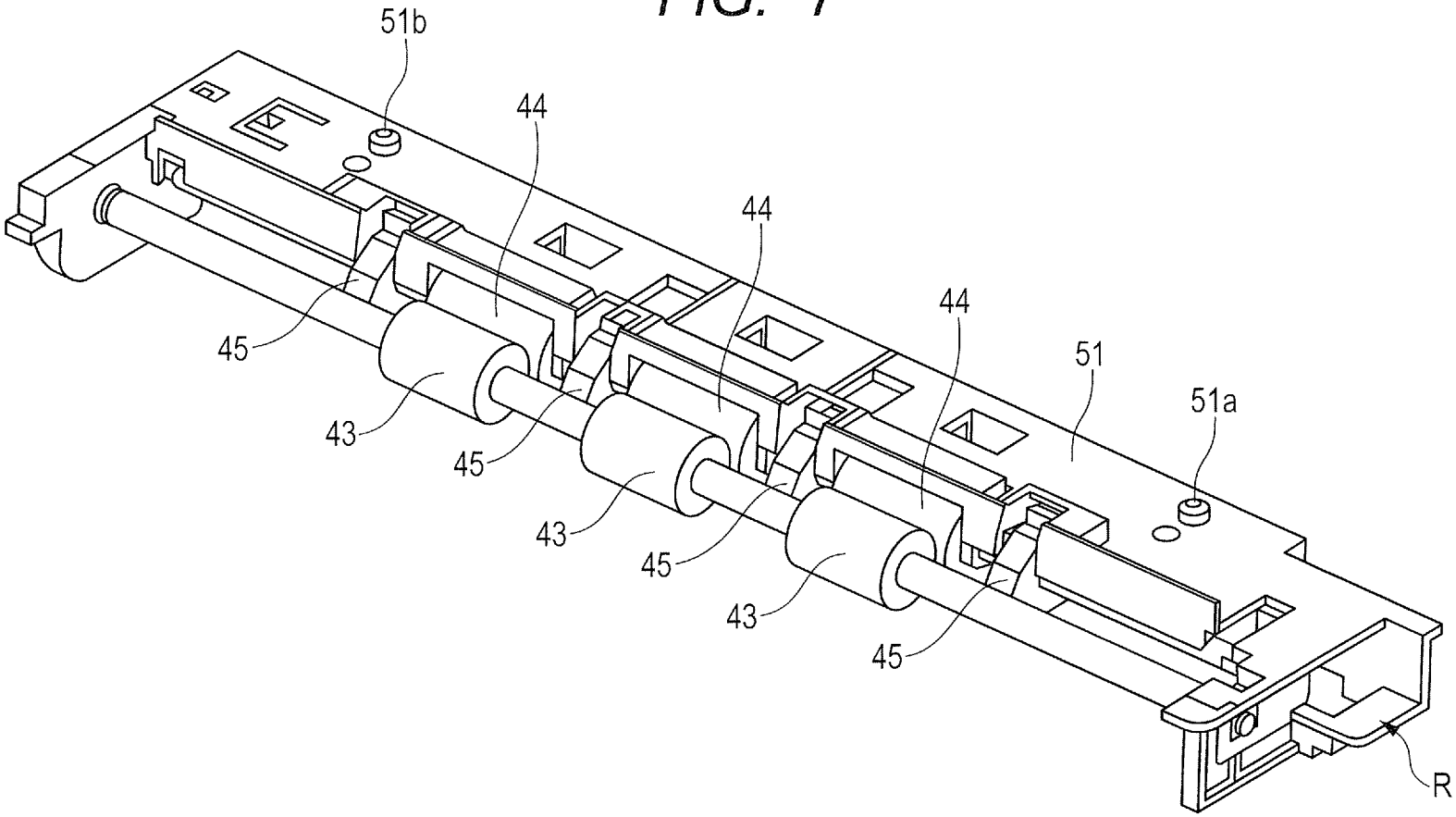
FIG. 7 is a perspective view for illustrating a detailed configuration of a registration unit according to the embodiment of the present invention.

FIG. 7 is a perspective view for illustrating the detailed configuration of the registration unit R.

In FIG. 7, positioning bosses 51*a* and 51*b* and the registration shutters 45 arranged on the shaft portion of the registration idler rollers 44 are illustrated. The recording material S is subjected to correction of skew feeding performed by the registration shutters 45, and is guided into the nips between the registration drive rollers 43 and the registration idler rollers 44.

<<Configuration of Fixing Registration Unit R on Main Stay 9>>

Figure 8:
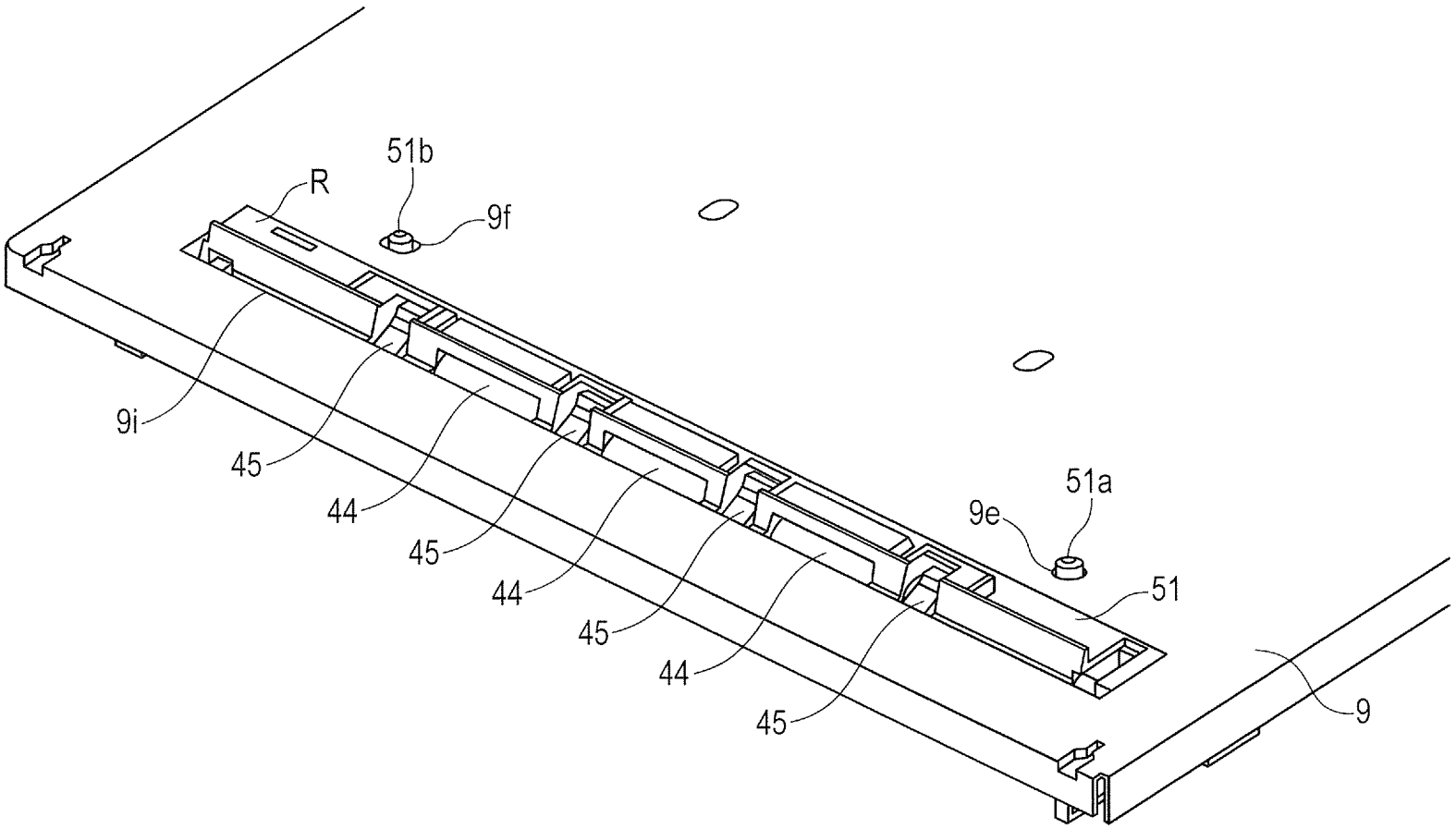
FIG. 8 is a perspective view for illustrating a state in which the registration unit according to the embodiment of the present invention is fixed on the main stay.

FIG. 8 is a perspective view for illustrating a state in which the registration unit R is fixed on the main stay 9. As illustrated in FIG. 8, the positioning boss 51*a* of the registration unit R is inserted into the round positioning hole 9*e* of the main stay 9, and the positioning boss 51*b* is inserted into the oblong positioning hole 9*f* of the main stay 9. In this manner, the registration unit R is positioned on the main stay 9.

Figure 9:
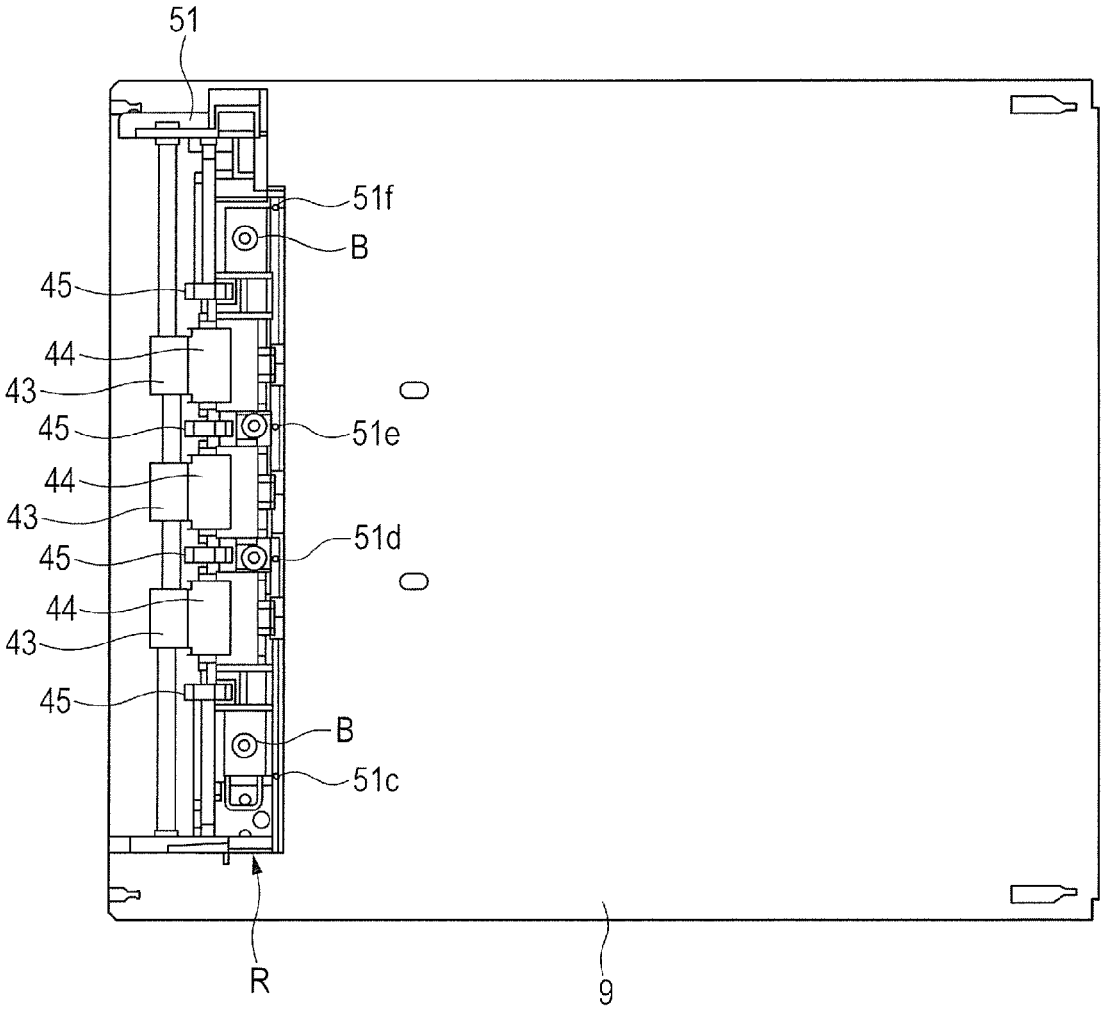
FIG. 9 is a view for illustrating the state illustrated in FIG. 8 in which the registration unit is fixed on the main stay when viewed from a back surface side of the image forming apparatus.

FIG. 9 is a bottom view for illustrating the state illustrated in FIG. 8 in which the registration unit R is fixed on the main stay 9 when viewed from a back surface side of the image forming apparatus.

As illustrated in FIG. 9, the registration unit R is secured and fixed on the main stay 9 with two screws B.

<<Configuration of Positioning Registration Unit R and Pickup Unit K>>

Next, a configuration of positioning the registration unit R and the pickup unit K is described.

Figure 10:
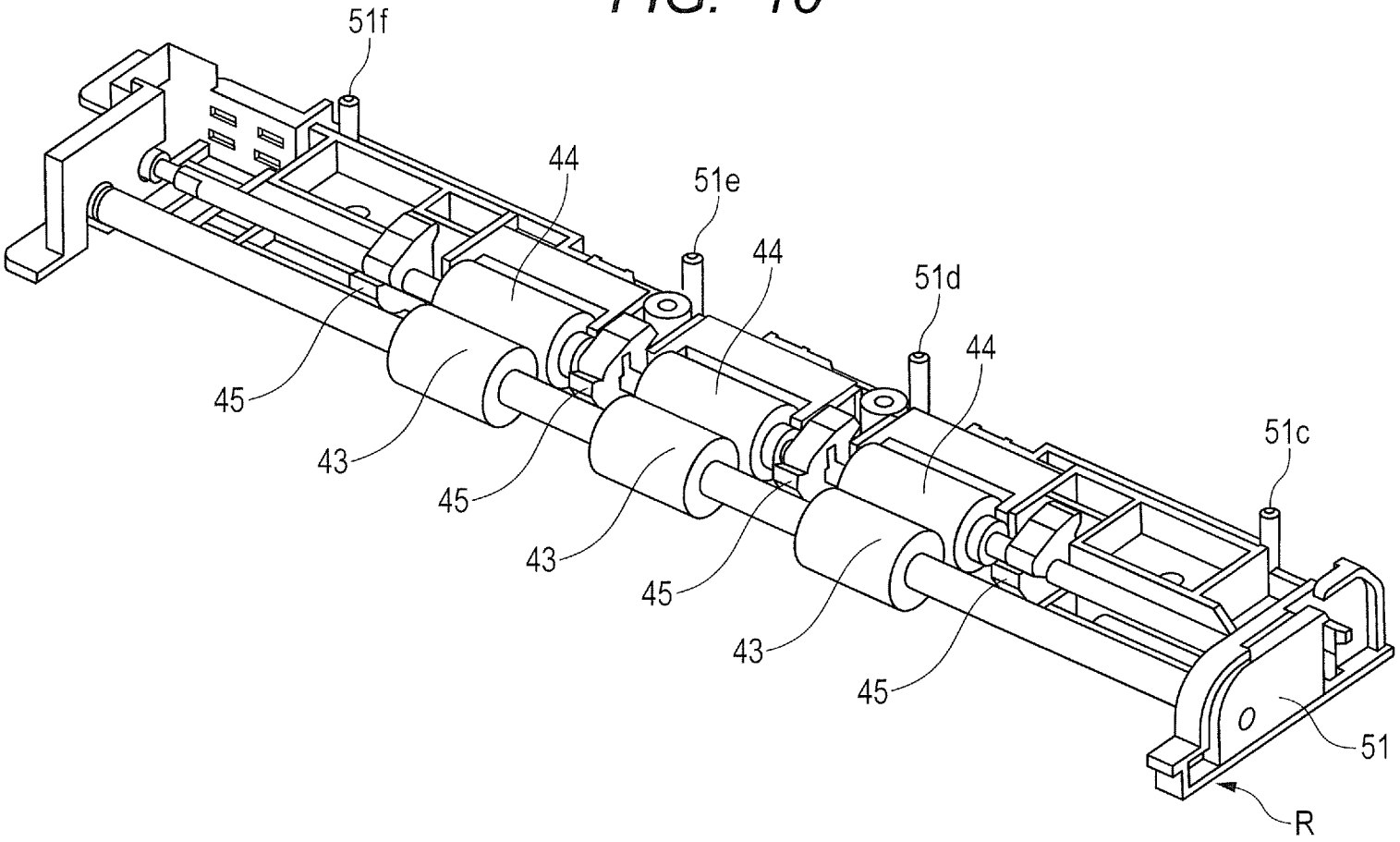
FIG. 10 is a perspective view for illustrating the registration unit when viewed from a side opposite to the side illustrated in FIG. 7.

FIG. 10 is a perspective view for illustrating the registration unit R when viewed from a side opposite to the side illustrated in FIG. 7. In FIG. 10, positioning bosses 51*c*, 51*d*, 51*e*, and 51*f* are illustrated.

Figure 11:
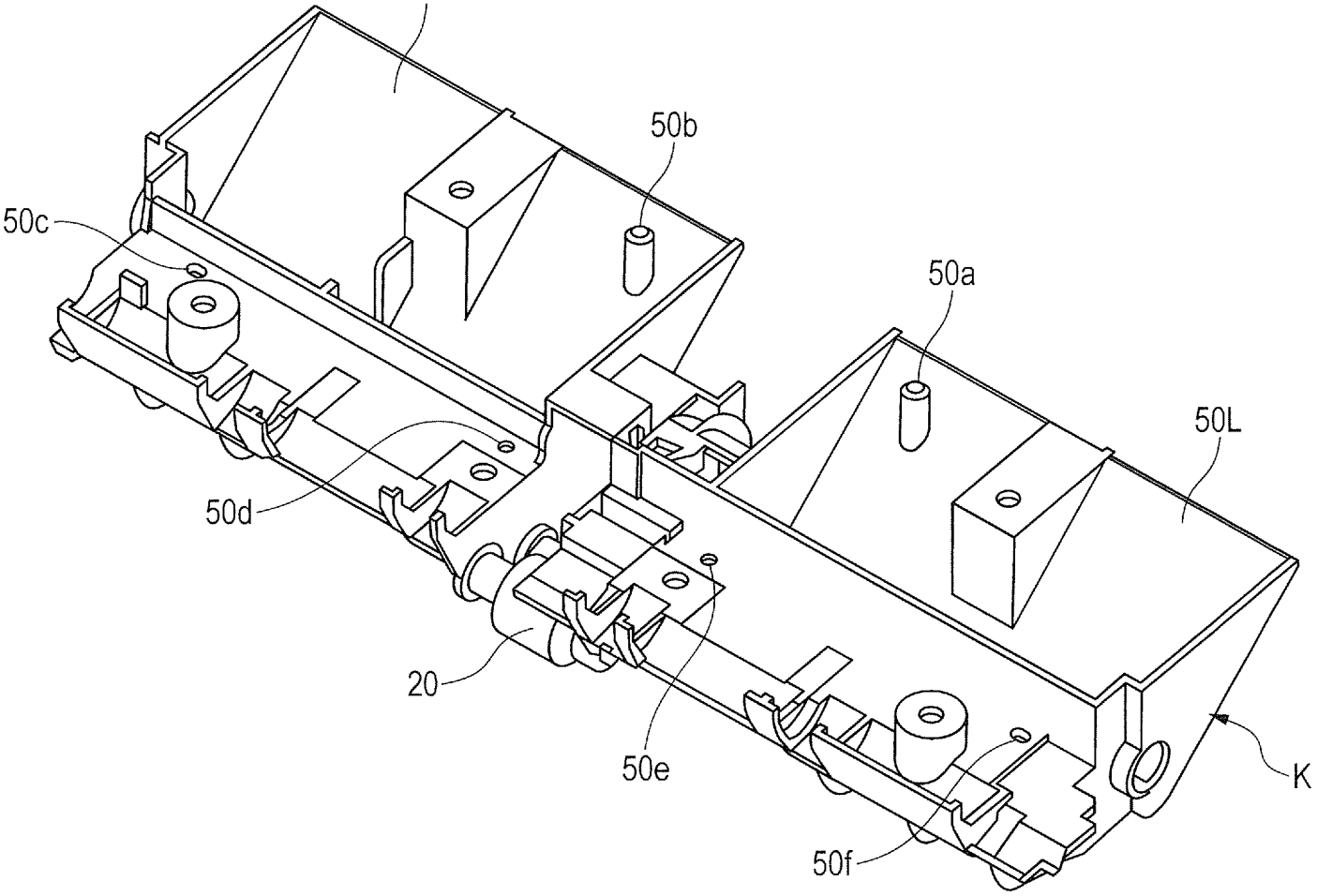
FIG. 11 is a perspective view for illustrating a detailed configuration of a pickup unit according to the embodiment of the present invention.

FIG. 11 is a perspective view for illustrating a detailed configuration of the pickup unit K. In FIG. 11, a right cover 50R of the FP cover 50 (hereinafter referred to as "right FP cover portion"), a left cover 50L of the FP cover 50 (hereinafter referred to as "left FP cover portion"), positioning bosses 50*a* and 50*b*, oblong positioning holes 50*c* and 50*f*, and round positioning holes 50*d* and 50*e* are illustrated.

The feed roller 20 and the pickup roller 30 are held by the right FP cover portion 50R and the left FP cover portion 50L.

<<Configuration of Mounting Pickup Unit K and Registration Unit R to Main Stay 9>>

Next, a configuration of mounting the pickup unit K and the registration unit R to the main stay 9 is described.

Figure 12:
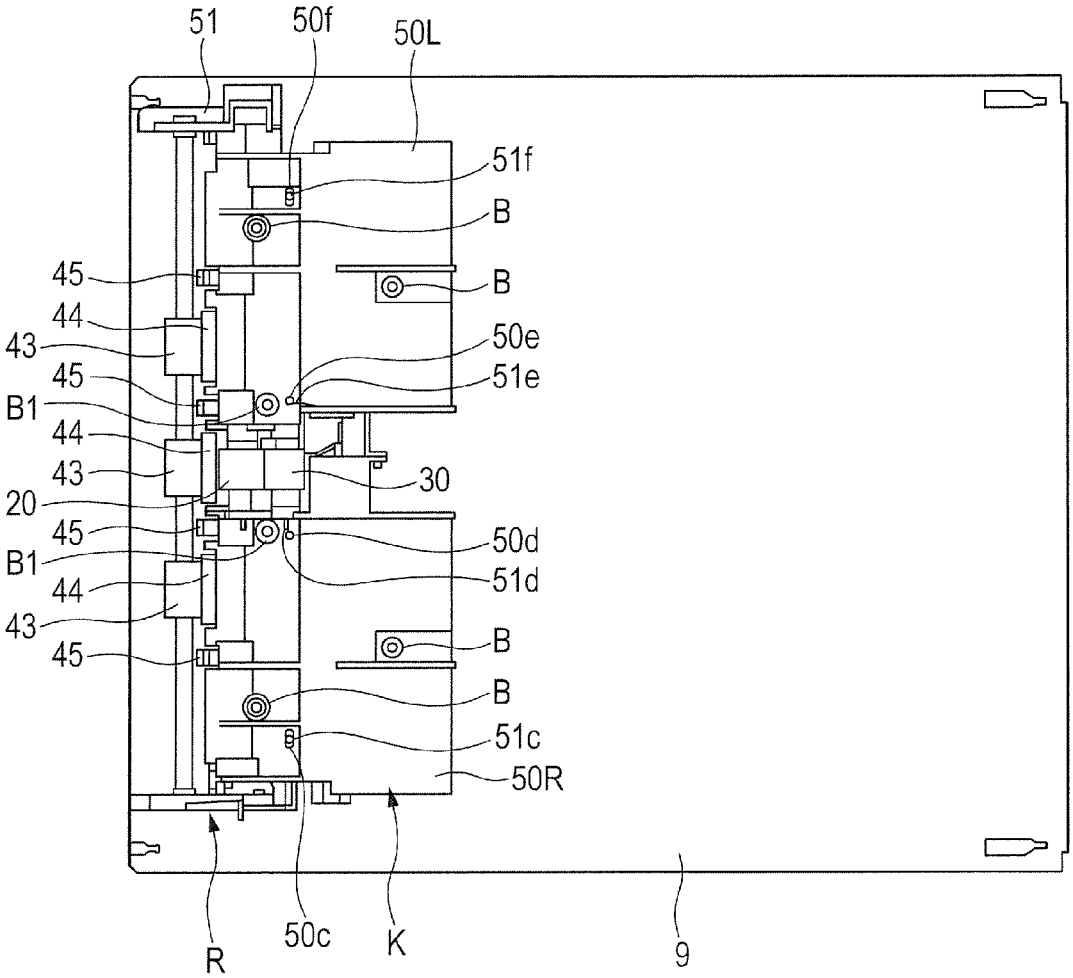
FIG. 12 is a view for illustrating the main stay to which the registration unit and the pickup unit are mounted.

FIG. 12 is a bottom view for illustrating a state in which the registration unit R and the pickup unit K are mounted to the main stay 9.

As illustrated in FIG. 12, the registration unit R is fixed on the main stay 9 with the screws B. The positioning boss 51*e* of the registration cover 51 is fitted into the round positioning hole 50*e* of the left FP cover portion 50L, and the positioning boss 51*d* of the registration cover 51 is fitted into the round positioning hole 50*d* of the right FP cover portion 50R. Further, the positioning boss 51*f* of the registration cover 51 is inserted into the oblong positioning hole 50*f* of the left FP cover portion 50L, and the positioning boss 51*c* of the registration cover 51 is inserted into the oblong positioning hole 50*c* of the right FP cover portion 50R. Thus, the registration unit R is positioned. The registration unit R and the pickup unit K are fastened and fixed at two positions with screws B1.

Figure 13:
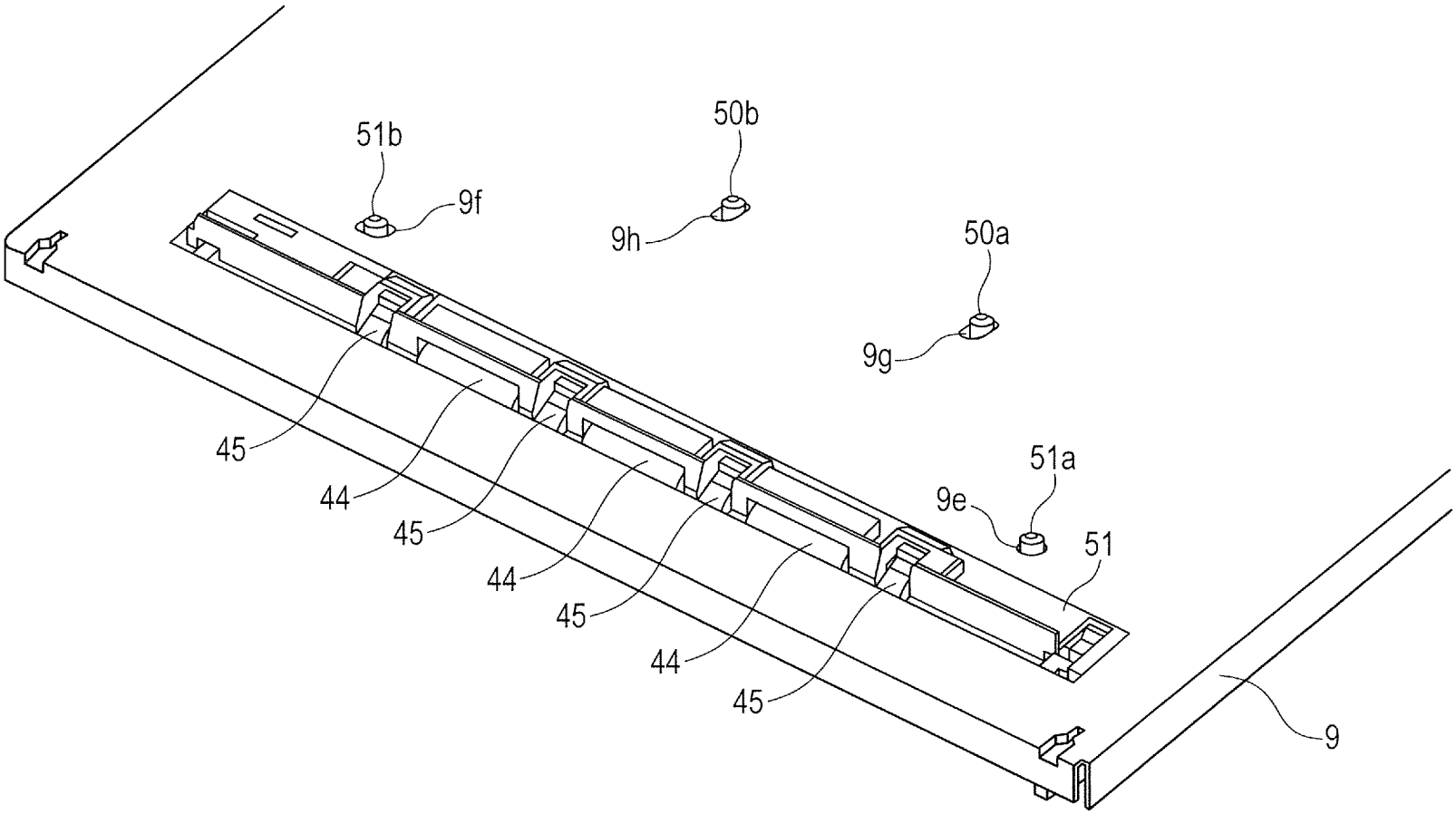
FIG. 13 is a perspective view for illustrating the main stay illustrated in the bottom view of FIG. 12 when viewed from a side opposite to the side illustrated in FIG. 12 (from the above side).

FIG. 13 is a perspective view for illustrating the state illustrated in the bottom view of FIG. 12 when viewed from a side opposite to the side illustrated in FIG. 12 (from above).

As illustrated in FIG. 13, the positioning boss 50*a* of the left FP cover portion 50L is inserted into the oblong positioning hole 9*g* of the main stay 9, and the positioning boss 50*b* of the right FP cover portion 50R is inserted into the oblong positioning hole 9*h* of the main stay 9. In this manner, the pickup unit K is positioned on the main stay 9 in the right-and-left direction.

At this time, the pickup unit K is positioned by the registration unit R. Accordingly, when fitted onto the main stay 9, the pickup unit K may be sometimes slightly deformed. However, the left FP cover portion 50L and the right FP cover portion 50R have low strength, to thereby follow positioning of the main stay 9.

Description is continued referring back to FIG. 12. The pickup unit K is fastened to the main stay 9 at two positions with the screws B to be fixed on the main stay 9.

The registration unit R and the pickup unit K are mounted to the main stay 9 in this manner, thereby ensuring accuracy of positions of the registration unit R and the pickup unit K on the main stay 9, and keeping strength.

<<Configuration of Mounting Separation Roller Unit T>>

Next, a configuration of mounting the separation roller unit T is described.

Figure 14:
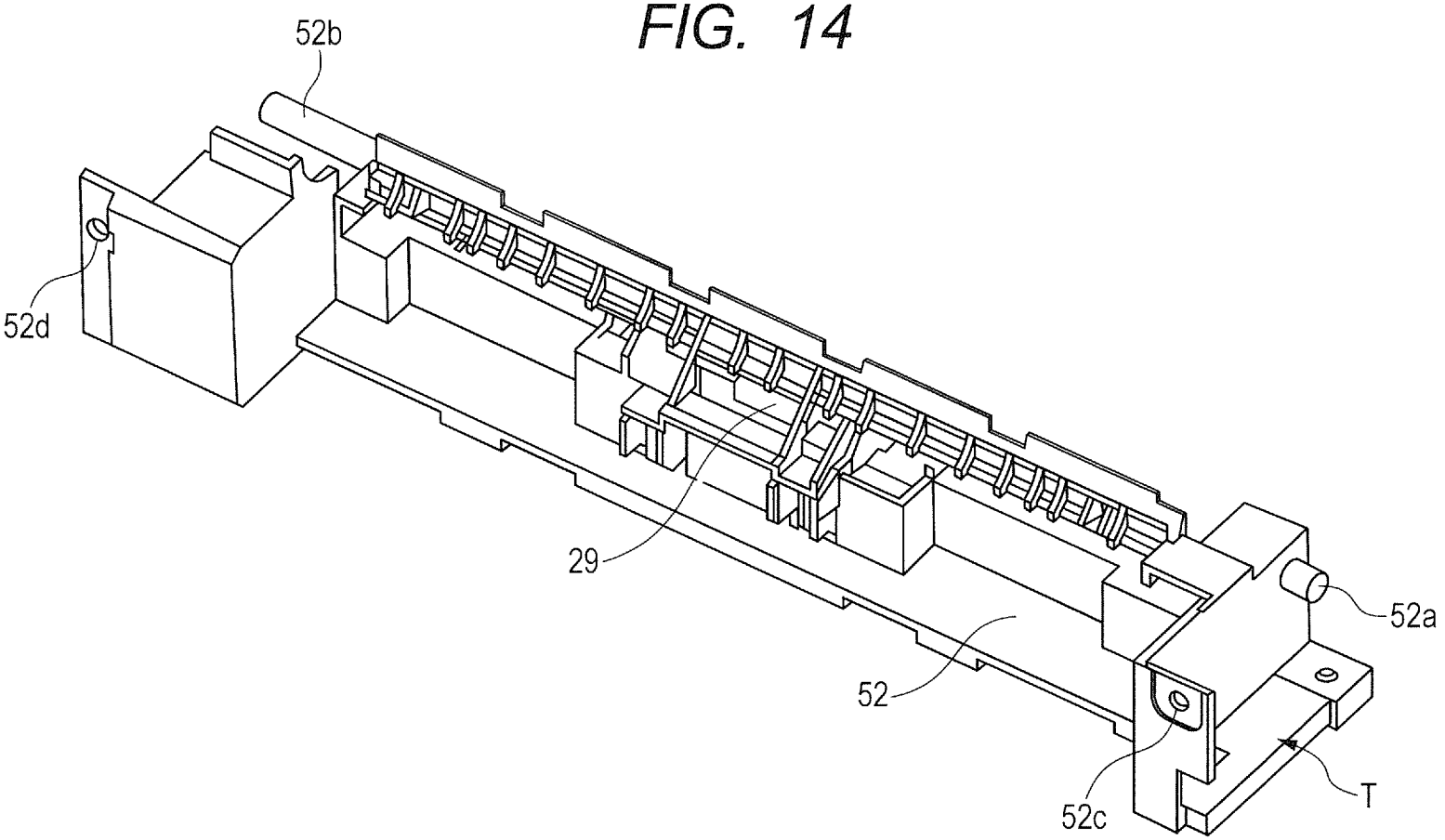
FIG. 14 is a perspective view for illustrating a separation roller unit according to the embodiment of the present invention.

FIG. 14 is a perspective view for illustrating the separation roller unit T.

In FIG. 14, positioning bosses 52*a* and 52*b* and screw fastening holes 52*c* and 52*d* formed in the separation roller holding cover 52 are illustrated.

Figure 15:
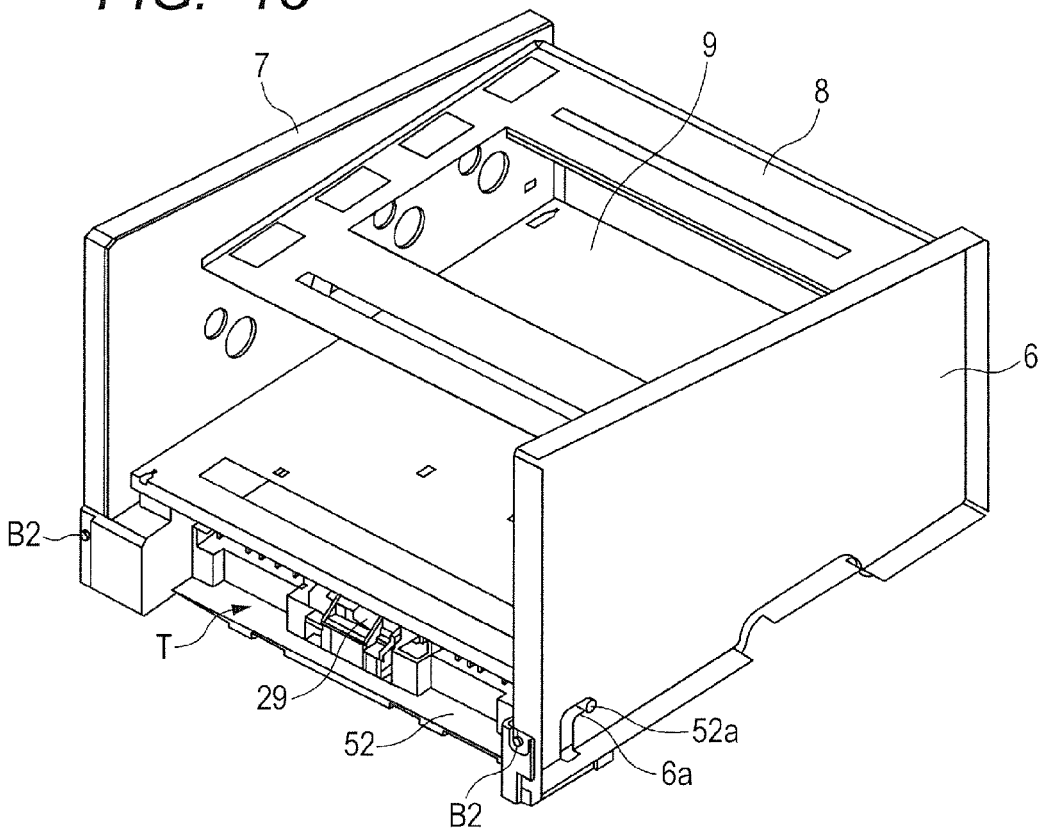
FIG. 15 is a perspective view for illustrating a state in which the separation roller unit is mounted to frame members of an apparatus main body.

FIG. 15 is a perspective view for illustrating a state in which the separation roller unit T is mounted to the frame members (left side plate 6 and right side plate 7) of the apparatus main body 2.

As described above, the main stay 9 is fastened to the left side plate 6 and the right side plate 7, and the main stay 9 connects the left side plate 6 and the right side plate 7 to each other. As illustrated in FIG. 15, the positioning boss 52*a* of the separation roller unit T is inserted into an L-shaped positioning hole 6*a* of the left side plate 6, thereby positioning the separation roller unit T on the left side plate 6. The separation roller unit T is also positioned on the right side plate 7 in a similar manner.

Further, screws B2 are fastened into the screw fastening holes 52*c* and 52*d* so that the separation roller unit T is fastened and fixed on the left side plate 6 and the right side plate 7.

Figure 16:
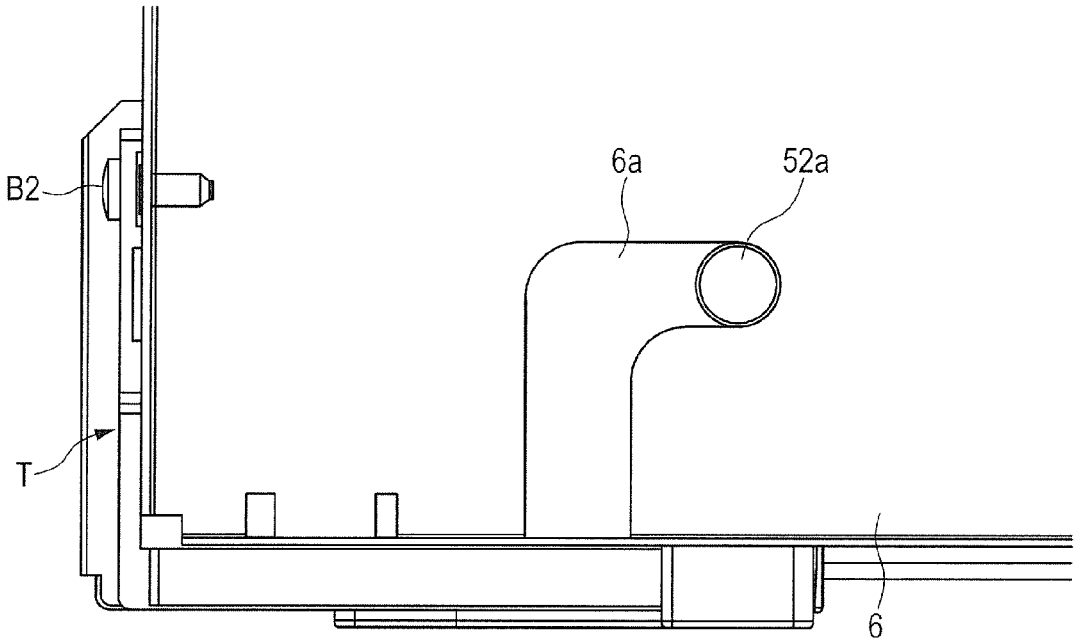
FIG. 16 is a side view for illustrating a state in which the separation roller unit is mounted to a left side plate.

FIG. 16 is a side view for illustrating a state in which the separation roller unit T is mounted to the left side plate 6.

As illustrated in FIG. 16, the positioning boss 52*a* is inserted into the L-shaped positioning hole 6*a* of the left side plate 6, and the separation roller unit T is fastened to the left side plate 6 with the screw B2. In this manner, the positioning boss 52*a* is brought into abutment on an end portion of the L-shaped positioning hole 6*a*, thereby positioning the separation roller unit T. The right side plate 7 side has the same configuration.

<<Effects>>

With the above-mentioned configuration, the following effects can be obtained.

(1) In this embodiment, the registration unit R, and the belt unit 11 including the transfer belt 12 onto which the toner image is primarily transferred are positioned on the main stay 9, and the pickup unit K is positioned on the registration unit R and the main stay 9. Accordingly, the belt unit 11 and the nips between the pairs of registration rollers 43 and 44 are positioned with good accuracy, and the pairs of registration rollers 43 and 44, the feed roller 20, and the pickup roller 30 are also positioned with good accuracy.

Thus, the recording material S, which is fed by the pickup roller 30 and conveyed by the feed roller 20, is more stably conveyed to the pairs of registration rollers 43 and 44 with less skew feeding amount and the like. The recording material S is conveyed to the pairs of registration rollers 43 and 44 with less skew feeding amount, thereby being capable of more reliably correcting skew feeding even at the pairs of registration rollers 43 and 44. In addition, the recording material S, which has been subjected to correction of skew feeding, is stably conveyed to the secondary transfer portion T2 (image forming portion), thereby further stabilizing printing accuracy.

(2) In this embodiment, the pickup unit K and the separation roller unit T are constructed as separate units, and the pickup unit K holds the feed roller 20 and the pickup roller 30 that are arranged side by side along a conveying direction of the recording material. Accordingly, a height of the unit can be reduced.

Thus, even when rigidity of the FP cover 50 is reduced as compared to the related-art configuration in which the pickup unit K and the separation roller unit T are constructed as an integrated unit, strength can be ensured by mounting the pickup unit K to the registration unit R and the main stay 9. Further, in a state of the unit before being mounted to the main stay 9, the pickup unit K need not have rigidity. Thus, a thickness of the FP cover 50 can be reduced, and a rib and the like for reinforcement can be omitted or minimized. Accordingly, cost reduction can be realized.

In this embodiment, after the registration unit R is mounted to the main stay 9, the pickup unit K is also mounted to the main stay 9. However, the present invention is not limited thereto. That is, after the registration unit R and the pickup unit K are previously assembled into a unit, the registration unit R and the pickup unit K may be mounted to the main stay 9. Further, as long as the registration unit R and the pickup unit K are positioned and fixed on the main stay 9, there may be adopted a configuration in which the registration unit R and the pickup unit K are not assembled.

Further, in this embodiment, the registration unit R and the pickup unit K are positioned and fixed on the main stay 9 as the sheet feeding unit 18, but the present invention is not limited thereto. It is only necessary that at least one of the registration unit R or the pickup unit K be positioned and fixed on the main stay 9 as the sheet feeding unit. Further, it is not always necessary that the sheet feeding unit positioned and fixed on the main stay 9 be constructed by the registration unit R and the pickup unit K as in this embodiment. That is, it is only necessary that the sheet feeding unit include at least one of the sheet feeding devices such as the pickup roller 30 or the skew feeding correction device such as the pair of registration rollers 43 and 44.

Further, in this embodiment, the recording materials S in the sheet feeding tray 19 are fed one by one by the pickup roller 30, the feed roller 20, and the separation roller 29, but the present invention is not limited thereto. The recording materials S in the sheet feeding tray 19 may be fed one by one with, for example, a publicly known configuration including a sheet feeding roller and a separation pad. In this case, it is preferred that a unit holding the sheet feeding roller be retained by the registration unit R and the main stay 9, and that the separation pad be retained by a separate component such as a bottom plate.

The image forming apparatus of an intermediate transfer type is described, but the present invention is not limited thereto. That is, the present invention is also suitably applicable to an image forming apparatus of a direct transfer type that includes, as a belt, instead of the transfer belt 12, a recording material conveying belt configured to convey the recording material while bearing the recording material. In the image forming apparatus of the direct transfer type, toner images formed on the surfaces of the respective photosensitive members are sequentially and directly transferred onto a recording material that is conveyed (borne and conveyed) by the belt to the respective image forming portions, thereby forming a color image. In this configuration, a sheet feeding unit feeds the recording material toward the belt so as to cause the recording material to be borne and conveyed by the belt. Such an image forming apparatus is well known, and hence further description is omitted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-248031, filed Dec. 8, 2014, which is hereby incorporated by reference herein in its entirety.

What is claimed is:

1. An image forming apparatus, comprising:

a photosensitive member on which a toner image is formed;

a belt unit including an endless and rotatable belt configured to secondarily transfer the toner image primarily transferred from the photosensitive member onto a recording material;

a sheet feeding unit configured to feed a recording material toward a belt; and a positioning member configured to position the belt unit, wherein the sheet feeding unit comprises:

a sheet feeding device configured to feed recording materials, a first unit configured to support the sheet feeding device, a skew feeding correction device configured to correct skew feeding of the recording materials fed by the sheet feeding device, and a second unit configured to support the skew feeding correction device, the first unit and the second unit positioned and fixed on the positioning member and to each other.

2. An image forming apparatus according to claim 1, further comprising:

a separation device configured to separate one by one the recording materials fed by the sheet feeding device;

a third unit configured to support the separation device; and a pair of side plates serving as frame members of the image forming apparatus, which are arranged so as to be opposed to each other, wherein the third unit is positioned on the pair of side plates.

3. An image forming apparatus according to claim 1, wherein the belt unit comprises:

a plurality of rollers configured to stretch the endless and rotatable belt in a rotatable manner; and a support frame configured to support the plurality of rollers in a rotatable manner, and wherein the support frame is positioned and fixed on the positioning member so that the belt unit is positioned and fixed on the positioning member.

4. An image forming apparatus according to claim 1, further comprising:

a pair of side plates arranged so as to be opposed to each other; and a connecting member configured to connect the pair of side plates to each other, the pair of side plates and the connecting member serving as frame members of the image forming apparatus, wherein the connecting member also serves as the positioning member.

5. An image forming apparatus according to claim 4, wherein the belt unit is fixed with fasteners with regard to the connecting member.

6. An image forming apparatus according to claim 4, wherein the connecting member is a plate element configured to support the belt unit in a condition where the belt unit is positioned.

7. An image forming apparatus according to claim 6, wherein the connecting member has a plurality of positioning holes.

8. An image forming apparatus according to claim 7, wherein the plurality of positioning holes comprises a first positioning hole, a second positioning hole, a third positioning hole and a forth positioning hole, wherein each of the first positioning hole, the second positioning hole, the third positioning hole and the forth positioning hole engage the belt unit, and wherein each of the first positioning hole, the second positioning hole, the third positioning hole and the forth positioning hole has a slit whose width is narrower than a width of other area.

9. An image forming apparatus according to claim 8, wherein the belt unit contacts the slit in a condition where the connecting member is positioned.

10. An image forming apparatus according to claim 7, wherein the plurality of positioning holes comprises a first positioning hole, a second positioning hole, a third positioning hole, a forth positioning hole, a fifth positioning hole and a sixth positioning hole, wherein the fifth positioning hole and the sixth positioning hole engage the second unit.

* * * * *